US008264335B2

(12) United States Patent
Dehlin et al.

(10) Patent No.: US 8,264,335 B2
(45) Date of Patent: Sep. 11, 2012

(54) DEVICE ATTACHED TO A BLISTER

(75) Inventors: Marcus Dehlin, Karlstad (SE); Lars Sandberg, Hammaro (SE); Ingrid Rokahr, Munkfors (SE)

(73) Assignee: Stora Enso AB, Falun (SE)

( * ) Notice: Subject to any disclaimer, the term of this patent is extended or adjusted under 35 U.S.C. 154(b) by 708 days.

(21) Appl. No.: 12/520,393

(22) PCT Filed: Dec. 19, 2007

(86) PCT No.: PCT/SE2007/051039

§ 371 (c)(1),
(2), (4) Date: Jun. 19, 2009

(87) PCT Pub. No.: WO2008/079090

PCT Pub. Date: Jul. 3, 2008

(65) Prior Publication Data

US 2010/0094455 A1 Apr. 15, 2010

Related U.S. Application Data

(60) Provisional application No. 60/876,865, filed on Dec. 22, 2006.

(51) Int. Cl.

| | |
|---|---|
| ***G08B 1/00*** | (2006.01) |
| ***G08B 23/00*** | (2006.01) |
| ***G07F 11/00*** | (2006.01) |

(52) U.S. Cl. ..... 340/309.16; 340/309.3; 340/309.7; 340/573.1; 368/1; 368/10; 221/2; 221/3; 221/4; 221/7; 221/9; 367/199

(58) Field of Classification Search ..... 340/309.16; 368/1; 221/2, 3, 4

See application file for complete search history.

(56) References Cited

U.S. PATENT DOCUMENTS

| | | | | |
|---|---|---|---|---|
| 4,526,474 | A | 7/1985 | Simon | |
| 4,617,557 | A | 10/1986 | Gordon | |
| 4,971,221 | A * | 11/1990 | Urquhart et al. | 221/2 |
| 5,181,189 | A | 1/1993 | Hafner | |
| 7,286,907 | B2 * | 10/2007 | Schanin et al. | 700/300 |
| 2005/0122219 | A1 * | 6/2005 | Petersen et al. | 340/568.1 |

FOREIGN PATENT DOCUMENTS

| | | |
|---|---|---|
| WO | 03090663 | 6/2003 |
| WO | 03055769 | 10/2003 |
| WO | 2007043858 | 4/2007 |

* cited by examiner

*Primary Examiner* — Donnie Crosland
(74) *Attorney, Agent, or Firm* — Greer, Burns & Crain, Ltd.

(57) ABSTRACT

A device adapted to be releasable attached to a blister including at least one piece of medicament. The device includes apparatus for releasable attachment to the blister, a sensor arrangement including at least one first sensor arranged to register the sound of the dispense of a piece of medicament, a time system arranged to register the time and/or date of the dispensing of said piece of medicament and a memory for storing data, such as time and/or date data, related to the dispense of the piece of medicament.

15 Claims, 3 Drawing Sheets

34

| B1 | B2 | B3 |
|---|---|---|
| AD1 | AD2 | AD2 |
| DS1 | DS2 | DS3 |
| DD1 | DD2 | DD3 |

DEVICE ATTACHED TO A BLISTER

This application is a U.S. National Phase under 35 U.S.C. §371 of International Application No. PCT/SE2007/051039, filed Dec. 19, 2007, which claims priority from U.S. Provisional Patent Application No. 60/876,865, filed Dec. 22, 2006.

The present invention relates to blisters comprising medicaments. The present invention more particularly relates to a device adapted to be releasable attached to a blister.

BACKGROUND OF THE INVENTION

Many patients have problem to remember when to take or if they have taken their tablets or medicaments. It can also be difficult to remember at what time the last tablet was taken. It is, for many medicines, important to take them at regular time intervals. In some cases, for example heart medicines or insulin, it can even be lifesaving.

U.S. Pat. No. 4,526,474 describes a device for storing and periodically announcing the time for removal of drug doses. Each drug dose that is taken is registered by a system that is electrically connected to each blister cavity.

The device described in U.S. Pat. No. 4,526,474 has electrical circuits printed on the blister, which when broken indicates that a tablet has been dispensed. This makes the solution very complicated and expensive to produce.

Thus, there is a need for more simple and cost efficient device to monitor dispense of tablets or medicaments and especially one that can be used for many blisters.

SUMMARY OF INVENTION

It is an object of the invention to provide a device that registers the release of a piece of medicament provided in a blister, where the device is adapted to be used on any kind of blister.

This and other objects are according to a first aspect of the present invention achieved by a device adapted to be releasable attached to a blister including at least one piece of medicament, comprising means for releasable attachment to said blister, a sensor arrangement including at least one first sensor arranged to register the sound of the dispense of a piece of medicament, a time system arranged to register the time and/or date of the dispensing of said piece of medicament, and a memory for storing data, such as time and/or date data, related to the dispense of said piece of medicament.

Another object of the invention is to help a user in knowing when he/she is to take a medicament.

This is achieved through a second aspect that includes the features of the first aspect, further comprising a warning system arranged to alert a user when it is time to take a piece of medicament.

Another object of the invention is to make sure that the blister and thus the medicaments on it are authentic.

This is achieved through a third aspect that includes the features of the first aspect, where the dispensing of a piece of medicament causes the blister to emit a characteristic sound and the device further comprises an authentication system arranged to compare said registered sound of the dispense of a piece of medicament with a sound stored for an authentic blister and to indicate authenticity if they match.

The present invention has a number of advantages. Through the invention a user is helped in storing data of when his/her medicament was actually taken. All this is furthermore possible to do for various types of blisters and the device can be used on more than one blister. This means that blisters may be simple in construction. This also provides a user a large degree of flexibility in getting helped in relation to various blister types and various blisters of the same type.

BRIEF DESCRIPTION OF THE DRAWINGS

The present invention will now be described in more detail in relation to the enclosed drawings, where.

DETAILED DESCRIPTION OF THE INVENTION

A blister comprises at least one piece of medicament and preferably several pieces of medicament. A piece of medicament may be a tablet, a capsule or a pill.

Figure 1:
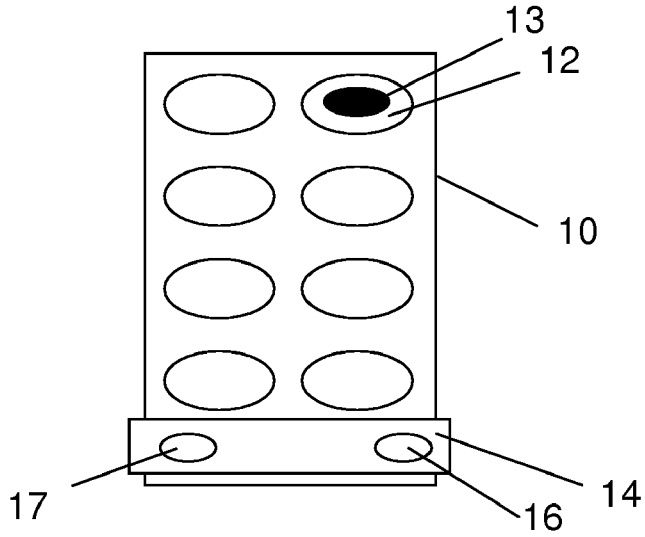
FIG. 1 shows a front view of a device according to the present invention attached to a blister.

One such blister is shown in a front view in FIG. 1. The blister 10 is of a common style, having one or several blister cavities 12 which may be closed by a backing foil that is adapted to rupture upon pressure on the blister cavity. Each cavity furthermore includes a piece of medicament 13. Preferably, pressure is thus also applied on cavity including the piece of medicament 13, which ruptures the backing foil. It is also possible to open a cavity by removing a pull tab that is covering the cavity. This is preferably used if the blister comprises frangible medicaments that can not stand the pressure when pushed from the cavity.

In FIG. 1 an exemplifying blister 10 is shown, which includes eight such cavities 12, each including a piece of medicament 13 in the form of a tablet, capsule or pill.

To the blister 10 there is attached a device 14 according to the present invention. The device 14 includes a sensor that registers the sound of the release of a piece of medicament. The device 14 is furthermore attached to the blister 10 in a releasable way. On the device 14 there is also provided an alerting unit 16, which may be a display, a speaker, or one or more LEDS (light emitting diodes). On the device 14 there may also be a user input unit 17, which may be in the form of a button. It should be realized that the user input unit may include more buttons or keys.

Figure 2:
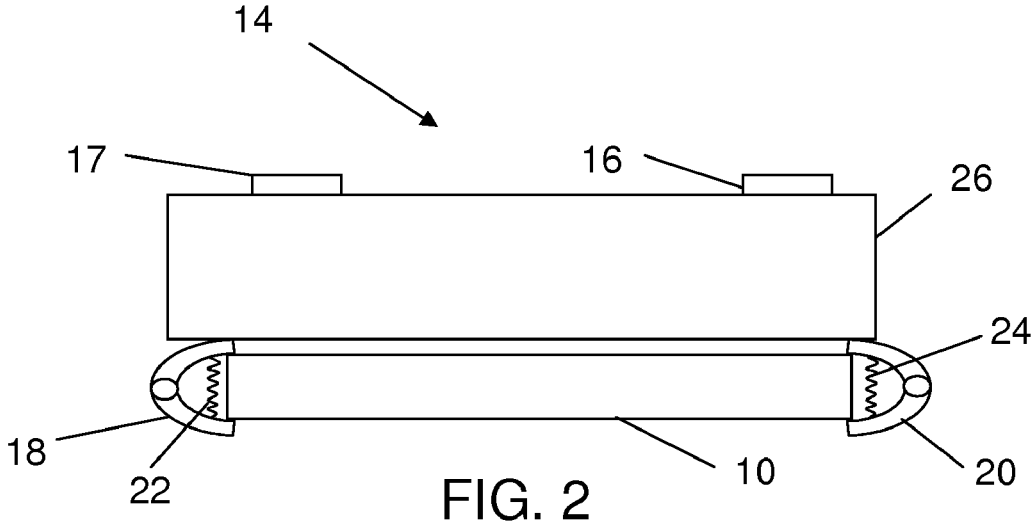
FIG. 2 shows a side view of the device according to the present invention.

FIG. 2 shows a side view of the device 14 according to the present invention being attached to a blister 10. The device 14 includes a housing 26 including various components and units and on which the alerting unit 16 and the user input unit 17 are placed. To the housing 26 there is furthermore connected means for releasable attachment of the device to said blister 10. Here said means for releasable attachment is provided in the form of a pair of clips 18 and 20 that may be clipped onto the blister 10, and here clipped onto opposite sides of the blister. For this reason each clip 18 and 20 may be provided with two arms and a spring 22 and 24 biased to force the two arms against each other. As the side of a blister 10 is brought between the two arms of a clip 18 the spring 22 forces the two arms against each other and thus this side of the blister 10 is held. It should here be realized that two such clips is a mere example and that more or fewer may be provided. It should also be realized that other ways of releasable attaching the device to a blister may be provided. The device 14 can through such means for releasable attachment therefore easily be attached and removed from the blister 10. The device 14 can thus be reused by moving it to another blister if a first blister is empty.

Figures 3, 4:
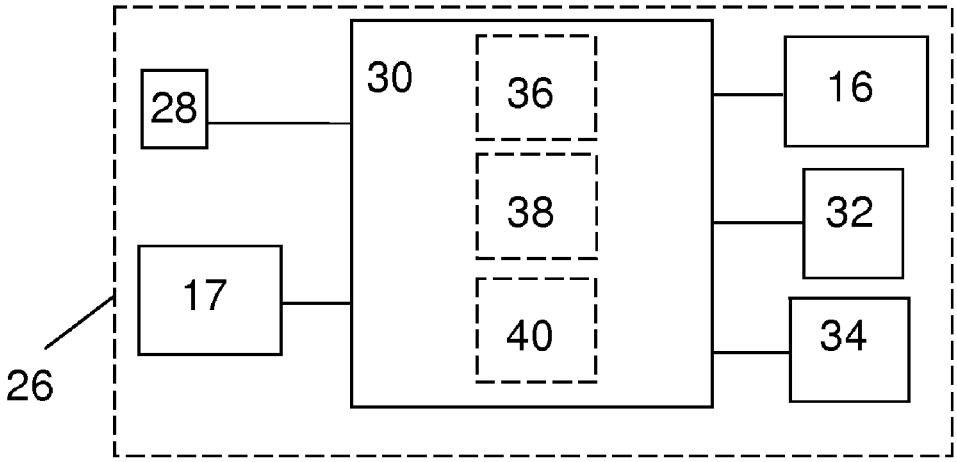
FIG. 3 shows a block schematic of various components and units in the device according to the present invention, FIG. 4 generally shows organization of data in a memory of the device according to the present invention.

FIG. 3 shows a block schematic of various units in the housing 26 of the device and used according to the present invention in order to register the dispensing of medicaments. There is according to the present invention a sensor arrangement including at least one first sensor 28. In a first embodiment of the present invention the arrangement does only include this first sensor 28. The sensor 28 is arranged to register the sound of the release of a piece of medicament, for instance a tablet, pill or medicament. The first sensor 28 is in turn connected to a control unit 30. The control unit 30 is connected to a clock 32, to a memory 34 as well as to the alerting unit 16 and the user input unit 17. The control unit 30 provides a number of applications, a time registering application 36, a warning application 38 and an authentication application 40. These applications are in FIG. 3 shown as dashed boxes. It should here be realized that the device according to the present invention is normally provided with a power source, like a battery, in order to provide electrical power to the various units. However, it has here been omitted from the drawings in order to provide a better understanding of the present invention.

The device according to the present invention can be used for supporting the dispensing of medicaments. As an example it may be used for three different types of blisters, where each may include one or more medicaments. Here there is a first blister type B1, a second blister type B2 and a third blister type B3. It should here be realized that more or fewer blister types may be supported by the present invention. The memory 34 does because of this include data fields for each such blister type. As is shown in FIG. 4, the memory 34 includes an authentication data field AD1, AD2, AD3, a dispensing scheme data field DS1, DS2 and DS3 as well as a dispense data field DD1, DD2 and DD3 for each blister type B1, B2 and B3. The authentication data fields AD1, AD2 and AD3 here include authentication data being used for authenticating a blister, the dispensing scheme data fields DS1, DS2 and DS3 include data indicating when, i.e. at what points in time, the medicaments in a blister are to be taken while the dispense data fields DD1, DD2 and DD3 are filled with data regarding when medicaments of the corresponding blister has been dispensed.

The time registering application 36 of the control unit 30 and the clock 32 here make up a time system arranged to register the time and/or date of the dispensing of medicaments, the warning application 38 of the control unit 30, the clock 32, the dispensing scheme data fields DS1, DS2 and DS3 of the memory 34 and the alerting unit 16 here make up a warning system arranged to alert a user when it is time to take a medicament while the authentication application 40 of the control unit 30 and the authentication data fields AD1, AD2 and AD3 of the memory 34 makes up an authentication system.

Each blister can be designed to create a characteristic sound when a piece of medicament such as a tablet, capsule or pill is dispensed from the blister. The sound may depend on the material of the blister cavity, of the material of a possible material wrapped around the blister and above all on the material of the backing foil being ruptured.

The sensor of the device registers and recognizes the sound that arises from the release of a tablet. The sensor may need to be set on the right frequency and/or amplitude that is characteristic for the release of a piece of medicament of the blister to which it is attached. A user of the device may also select type of blister, which selection may be made in relation to selecting a certain medicament. This selection may be made via the user input unit, which thus functions as a means for changing the settings of the sensor in order to adapt it to a new kind of blister with a different characteristic sound.

As the device is attached to a new blister, the user of the device may therefore select which characteristic sound that is to be detected through making a selection of the blister type using the user input unit. The device may furthermore know in advance how many pieces of medicament there is in a blister of a certain type and set a blister counter to the number of pieces of medicament in the blister.

Figure 5:
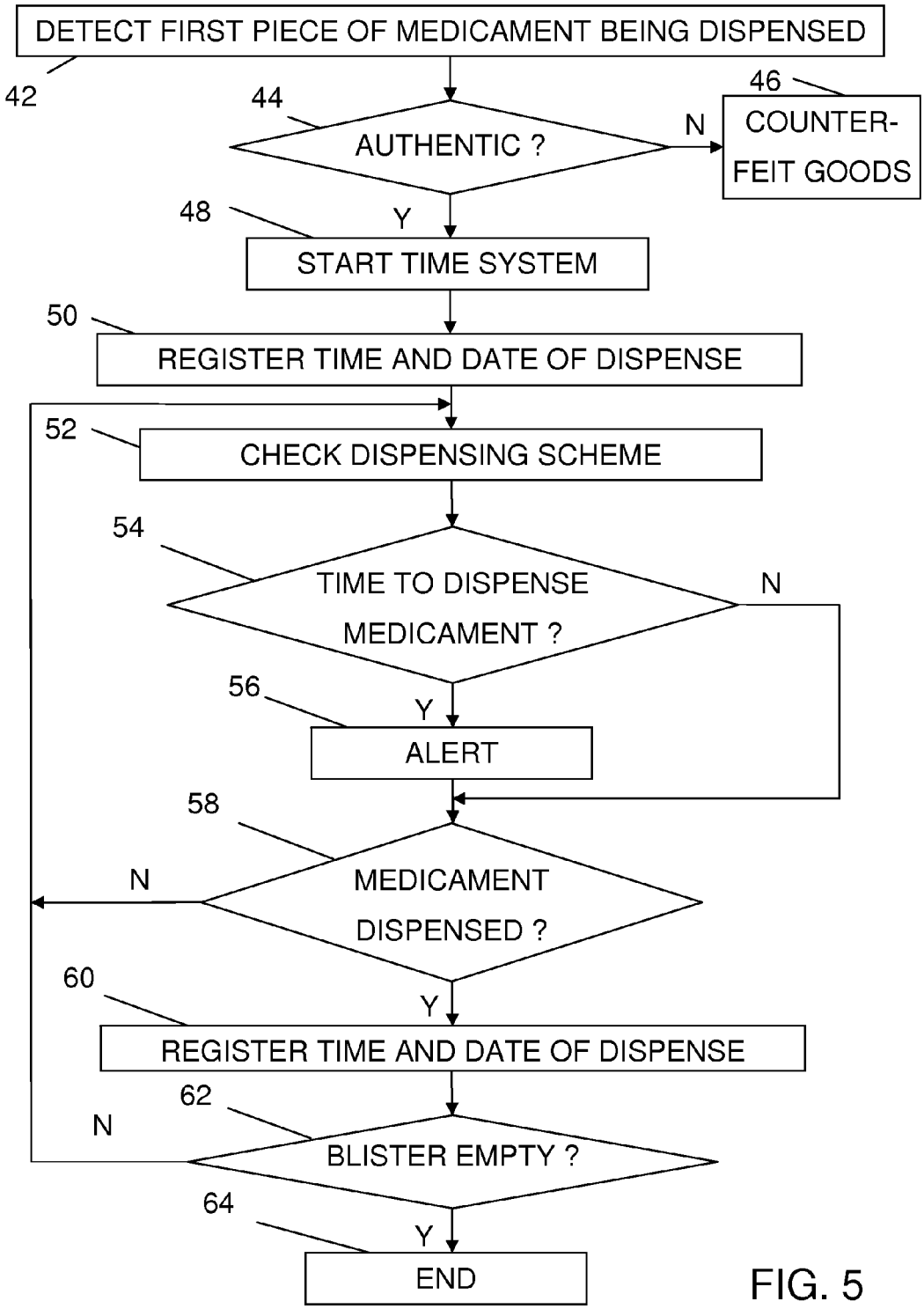
FIG. 5 shows a flow chart of a number of method steps being performed in the device of the present invention.

The functioning of the device as the device is being set for a new blister will now be described in relation to the previously described FIG. 1-4, as well as with reference being made also to FIG. 5, which shows a flow chart of a number of method steps being performed in the device of the present invention.

As a user thus has attached the device 14 to a blister 10 and indicated blister type, like for instance type B1, via the user input unit 17, the sensor 28 monitors the blister 10. The sensor 28 then detects a first piece of medicament 13 being dispensed, step 42, which is done through registering the sound of the dispensing of this piece of medicament 13 from the cavity 12 of the blister 10. When the sensor 28 recognizes the sound of the release of this piece of medicament 13 a signal is sent to the control unit 30. This signal corresponds to the sound of the cavity, for instance cavity 12, being broken. This signal is first supplied to the authentication application 40 of the control unit 40 in order to perform a checking of the authenticity of the blister, step 44.

The authentication application 40 then fetches the authentication data for the blister 10 in question, for example the first authentication data AD1 of the first type of blister B1 if the user had selected this type earlier. The authentication data AD1 includes sound data that may be characteristic for the rupture of the cavity like for instance data corresponding to a certain frequency and/or amplitude of the sound. The authentication application 40 then compares the sound detected by the sensor 28 with the authentication data AD1 and if the detected sound does not correspond to the authentication data AD1, the blister 10 is not the original one. Therefore the authentication application 40 indicates that the blister is counterfeit goods, step 46, which may be done via the alerting unit 16. If however the blister was authentic, step 44, a signal corresponding to the dispensing of the first piece of medicament 13 is provided to the time registering application 36, which starts or triggers the time system, step 48. The time registering application 36 then consults the clock 32 and registers the time and/or date of the dispensing in the dispense data field DD1 of the memory 34 for the corresponding blister B1, step 50. This information can be stored in order to make it possible to monitor that the medicament has been dispensed and at what time. The time registering application may at the same time decrease the blister counter by one.

This first registration of time data also starts the warning application 38, which then compares the registered time and/or date of the dispensing of the first piece of medicament with the dispensing scheme of the blister and the time and/or date of the clock 32, step 52. The dispensing scheme here indicates when it is time to dispense the next piece of medicament in the blister 10. In case the warning application 38 determines that it is time to dispense a new piece of medicament, step 54, it may alert the user via the alerting unit 16, step 56. The warning application 38 may here set off an alarm which can be visual and/or acoustic.

Here it is possible that the warning system can indicate both when it is time and when it is not time to take a piece of medicament. For example, a red light can be switched on when a piece of medicament has been taken and the light can turn to green when sufficient time has passed, and this indicates that it is time to take a piece of medicament again. If the piece of medicament is not taken within due time, an alarm may be generated.

In both cases, when there is time to dispense a new piece of medicament followed by an alerting and when it is not yet time, the sensor 28 keeps on monitoring if a new piece of medicament is dispensed, step 58. In case it is not, the warning application 38 keeps checking the dispensing scheme with the latest stored dispensing data DD1 and the time and/or date of the clock 32, step 52. If however a new piece of medicament was dispensed, step 58, the time registering application 36 registers the time and/or date of the dispensing, step 60, and then decreases the blister counter.

If then the blister 10 is empty, step 62, which happens if the blister counter reaches the value of zero, the method is ended, step 64, while if it is not empty, step 62, the checking of the dispensing scheme is resumed.

It should here be realized that as an alternative it is possible that the method is not ended when the blister is empty, but that the warning system instead indicates that the device should be attached to a new blister of the same type. As the device is attached to this new blister of the same type and the first piece of medicament in this new blister has been verified to be authentic, the blister counter may be set appropriately by the control unit and time registering and warning continued.

With the present invention it is possible to help a user to keep track of when he/she is to take his/her medicament. The user is furthermore helped in storing data of when his/her medicament was actually taken. This is furthermore possible to do for various types of blisters. This means that blisters may be simple in construction. This also provides a user a large degree of flexibility in getting helped in relation to various blister types and various blisters of the same type.

The above mentioned data in the dispense data fields of the memory can be provided to a medical expert if needed. For this reason the device according to the present invention may be provided with a communication interface, for instance a USB port or a wireless or infrared short range communication unit for example using Near Field Communication (NFC), IR or Bluetooth, for connection to a computer, PDA or mobile phone. Via this interface it is then possible to provide the computer, PDA or mobile phone with the above mentioned dispensing data and dispensing schemes. It is furthermore also possible to provide the device with various dispensing schemes, authentication data as well as blister size and blister type data from a computer, PDA or mobile phone via this interface. Here the blister size data may provide data indicating how many pieces of medicament there are in a blister. The dispensing scheme that is provided to a computer, PDA or mobile phone in this way furthermore enables the connection and/or synchronization of the dispensing scheme with the computer, PDA or mobile phone. In this way reminders of when a medicament is to be dispensed can be provided in a calendar function of the computer, PDA or the mobile phone. This also enables the sending of electronic messages regarding the dispensing of a medicament, for instance using e-mail, SMS or MMS from the computer, PDA or mobile phone.

There are many further variations that are possible to make in the device of the present invention. It is for instance possible that the warning system is omitted. In this case the device according to the present invention would only store data about when medicaments have been dispensed but not warn or remind a user of when such a medicament is to be taken. A piece of medicament may furthermore be dispensed by mistake at the wrong time. In this case it is possible that the user is warned that this piece of medicament is not to be taken and that data concerning the dispensing is not stored, i.e. the dispensing of the piece of medicament is ignored however while still decreasing the blister counter. In relation to this variation of the present invention it is as an alternative possibility that the piece of medicament is to be taken, data concerning the dispensing is stored and the dispensing scheme is adjusted in order to be adapted to this dispensing of a piece of medicament at the wrong time. It is furthermore possible that the device includes an attachment detector which detects that the device is attached to a blister. This may be done through providing a tension detector which detects the tension of the springs of the clip. When a blister is attached to the device, the spring of the clip will have a certain tension, which is then detected by the tension detector. The control unit may then compare this tension with a first stored tension value indicating that a blister is attached to the device and generate an attachment indication if the detected tension value corresponds to the stored first tension value. The control unit may in a similar way also detect that the blister is released from the device through comparing a detected tension of the spring with a second tension value indicating that no blister is attached to the device. When the attachment of the device to a new blister is detected in such a way it is furthermore possible to let the time system reset the above mentioned dispensing scheme or to change to another dispensing scheme.

It is furthermore possible that the device does not keep track of the fact that a blister is empty.

The dispensing scheme for a blister may furthermore be adjusted by a user through inputs made on the user input unit on the device in order to enable the use of the same device on different kinds of pharmaceuticals.

An increasing problem for pharmaceutical manufacturers is counterfeiting. The present invention can help pharmaceutical makers and patients to make sure that the medicaments that are taken are authentic. Since it is possible to design a unique sound for a blister it is possible to see whether the blister is authentic by using the device. It should however be realized that the authentication system may be omitted in the device and that the sensor can be arranged to just detect the dispensing of a piece of medicament but not the type.

The sensor arrangement may furthermore be arranged to detect which specific piece of medicament on a blister that has been dispensed.

This may be done through the blister being designed so that the sound of each cavity is unique and thus it is possible to register exactly which piece of medicament on the blister that has been dispensed. This may be done through each blister cavity being provided with a unique material and/or thickness of the backing foil. It can also be done by providing each blister cavity with a unique material and or thickness of material, each providing a sound that is characteristic for the cavity. Then the sensor arrangement would be arranged to detect which tablet is being dispensed through detecting the corresponding characteristic sound.

As an alternative it is possible that the sensor arrangement includes a second sensor being placed spaced apart from the first sensor and the sensor arrangement is arranged to detect which tablet is being dispensed through comparing a difference between the sound registered by the first sensor and the sound registered by the second sensor. This difference may be a time difference between when sound is registered by the two sensors. Here there may also be more sensors for instance three or four.

The sensor arrangement may furthermore perform the actual authentication checking. In this case the authentication application would provide the sensor arrangement with the settings to be used (frequency and/or amplitude). The sensor arrangement would then only provide a signal indicating that a blister is authentic perhaps together with a signal indicating that a piece of medicament has been dispensed.

The control unit where the time registering application, warning application and authentication application are provided may be provided as a processor with associated program memory comprising computer program code implementing these applications.

The sound that arises when the backing foil is ruptured and the tablet is dispensed, travels both in the blister material and/or in the air, is registered by the sensor. The sensor can sense the sound waves in the blister material and/or the sound waves that travel in the air.

The blister can be adapted to fit the device in an appropriate manner, it is for example possible that extra space is provided on one side of the blister. However, the device may also be attached to any blister without modifying the blister per se.

The blister cavity can be made of any suitable material, preferably polymer material or aluminum.

The possible material wrapped around the blister can be made of any suitable material, preferably paper, paperboard or polymer material.

The backing foil can be made of any suitable material, such as aluminum, polymer film or paper.

The sensor can be of any known type that registers sound, for example a sensor containing a piezoelectric element or a regular microphone.

As is evident from the description made above, the present invention may be varied in several ways. It is therefore clear that the invention is only to be limited by the accompanying claims

The invention claimed is:

1. A device adapted to be releasable attached to a blister including at least one piece of medicament, comprising means for releasable attachment to said blister, a sensor arrangement including at least one first sensor arranged to register the sound of the dispense of a piece of medicament, a time system arranged to register the time and/or date of the dispensing of said piece of medicament, and a memory for storing data, such as time and/or date data, related to the dispense of said piece of medicament.

2. The device according to claim 1, further comprising a warning system arranged to alert a user when it is time to take a piece of medicament.

3. The device according to claim 1, wherein the time system is arranged to be triggered by the first piece of medicament being dispensed from said blister.

4. The device according to claim 1, wherein the sensor arrangement is arranged to measure the frequency and/or the amplitude of the sound.

5. The device according to claim 1, wherein the sensor arrangement comprises at least one piezoelectric element.

6. The device according to claim 1, wherein the device further comprises means for changing the settings of the registration of sound, such as the change of frequency and/or the amplitude of the sound.

7. The device according to claim 1, wherein said means for releasable attachment to said blister comprises at least one clip to be clipped on to said blister.

8. The device according to claim 1, further comprising an attachment detector arranged to detect the attachment to a new blister.

9. The device according to claim 8, wherein the memory includes a dispensing scheme (DS1, DS2, DS3) and the time system is arranged to reset the dispensing scheme or change to another dispensing scheme when the device is detected as being attached to a new blister.

10. The device according to claim 1, wherein the dispensing of a piece of medicament causes said blister to emit a characteristic sound and further comprising an authentication system arranged to compare said registered sound of the dispense of a piece of medicament with a sound (AD1, AD2, AD3) stored for an authentic blister and to indicate authenticity if they match.

11. The device according to claim 1, wherein the memory includes frequency and/or amplitude settings associated with different blisters, where the sensor arrangement can be set to detect a particular blister.

12. The device according to claim 1, wherein the sensor arrangement is arranged to register which specific piece of medicament on the blister that has been dispensed.

13. The device according to claim 12, wherein the dispensing of a piece of medicament causes said blister to emit a separate characteristic sound and the sensor arrangement is arranged to detect which piece of medicament is being dispensed through registering the corresponding characteristic sound.

14. The device according to claim 12, wherein the sensor arrangement includes a second sensor being placed spaced apart from the first sensor and the sensor arrangement is arranged to detect which piece of medicament is being dispensed through comparing a difference between the sound registered by the first sensor and the sound registered by the second sensor.

15. The device according to claim 14, wherein the difference is a time difference.

* * * * *